US010899988B1

(12) United States Patent
Davis et al.

(10) Patent No.: US 10,899,988 B1
(45) Date of Patent: Jan. 26, 2021

(54) OCTANE HYPERBOOSTING IN FUEL BLENDS

(71) Applicant: National Technology & Engineering Solutions of Sandia, LLC, Albuquerque, NM (US)

(72) Inventors: Ryan Wesley Davis, San Jose, CA (US); Eric Monroe, Pleasanton, CA (US); Anthe George, San Francisco, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 16/438,763

(22) Filed: Jun. 12, 2019

Related U.S. Application Data

(60) Provisional application No. 62/685,141, filed on Jun. 14, 2018, provisional application No. 62/748,630, filed on Oct. 22, 2018.

(51) Int. Cl.
*C10L 10/10* (2006.01)
*C10L 1/182* (2006.01)

(52) U.S. Cl.
CPC ..... *C10L 10/10* (2013.01); *C10L 1/182* (2013.01); *C10L 2200/0469* (2013.01); *C10L 2290/24* (2013.01)

(58) Field of Classification Search
CPC combination set(s) only.
See application file for complete search history.

(56) References Cited

U.S. PATENT DOCUMENTS

| | | | | |
|---|---|---|---|---|
| 431,070 | A | 1/1982 | Rebafka | |
| 8,481,974 | B1 | 7/2013 | Davis et al. | |
| 8,790,542 | B2 | 7/2014 | Dibble et al. | |
| 9,403,915 | B2 | 8/2016 | Dibble et al. | |
| 10,077,454 | B1 | 9/2018 | Davis et al. | |
| 10,112,916 | B2 | 10/2018 | Sathitsuksanoh et al. | |
| 2009/0020090 | A1* | 1/2009 | Ryder | C10L 1/06 123/1 A |
| 2016/0332914 | A1* | 11/2016 | Gadt | C04B 24/2629 |

OTHER PUBLICATIONS

U.S. Appl. No. 15/066,651, filed Mar. 10, 2016, Wu et al.
U.S. Appl. No. 15/447,567, filed Mar. 2, 2017, Davis et al.
U.S. Appl. No. 16/388,385, filed Apr. 18, 2019, Davis et al.
American Petroleum Institute, "Determination of the potential property ranges of mid-level ethanol blends," Washington, DC, 2010 (107 pp.).
Anderson JE et al., "Octane numbers of ethanol-gasoline blends: measurements and novel estimation method from molar composition," *SAE Technical Paper* No. 2012-01-1274, 2012 (17 pp.).
Boot MD et al., "Impact of fuel molecular structure on auto-ignition behavior-design rules for future high performance gasolines," *Prog. Energ. Combust. Sci.* 2017;60:1-25.
Bu L et al., "Understanding trends in autoignition of biofuels: homologous series of oxygenated C5 molecules," *J. Phys. Chem. A* 2017;121:5475-86.
Cai L et al., "Optimized chemical mechanism for combustion of gasoline surrogate fuels," *Combust. Flame* 2015;162:1623-37.
Chou HH et al., "Synthetic pathway for production of five-carbon alcohols from isopentenyl diphosphate," *Appl. Environ. Microbiol.* 2012;78:7849-55.
Chow EW et al., "Benefits of a higher octane standard gasoline for the U.S. light-duty vehicle fleet," *SAE Technical Paper* No. 2014-01-1961, 2014, (18 pp.).
Christensen E et al., "Renewable oxygenate blending effects on gasoline properties," *Energy Fuels* 2011;25:4723-33.
Foong TM et al. "The octane numbers of ethanol blended with gasoline and its surrogates," *Fuel* 2014;115:727-39.
George KW et al., "Metabolic engineering for the high-yield production of isoprenoid-based $C_5$ alcohols in *E. coli," Sci. Rep.* 2015;5: Art. No. 11128 (12 pp.).
Ghosh P et al., "Development of a detailed gasoline composition-based octane model," *Ind. Eng. Chem. Res.* 2006;45:337-45.
Giglio V et al., "Experimental evaluation of reduced kinetic models for the simulation of knock in SI engines," *SAE Int'l Technical Paper* No. 2011-24-0033, 2011 (11 pp.).
Hoelderich WF et al., "Heterogeneously catalysed oxidations for the environmentally friendly synthesis of fine and intermediate chemicals: synergy between catalyst development and reaction engineering," in *Catalysis* (vol. 16, JJ Spivey (senior reporter)), The Royal Society of Chemistry, Cambridge, UK, 2002, Chapter 2, pp. 43-66.
Hunwartzen I, "Modification of CFR test engine unit to determine octane numbers of pure alcohols and gasoline-alcohol blends," *SAE Technical Paper Series* No. 820002, 1982 (6 pp.).
Inal F et al., "Effects of oxygenate additives on polycyclic aromatic hydrocarbons (PAHs) and soot formation," *Combustion Sci. Technol.* 2002;174:1-19.
Kogan SB et al., "Liquid phase isomerization of isoprenol into prenol in hydrogen environment," *Appl. Catal. A* 2006;297:231-6.
Lovell WG, "Knocking characteristics of hydrocarbons," *Ind. Eng. Chem.* 1948;40:2388-438.
Mack JH et al., "Investigation of biofuels from microorganism metabolism for use as anti-knock additives," *Fuel* 2014;117:939-43.
Maylin MV et al., "Calculation of gasoline octane numbers taking into account the reaction interaction of blend components," *Procedia Chem.* 2014;10:477-84.
McCormick RL et al., "Selection criteria and screening of potential biomass-derived streams as fuel blendstocks for advanced spark-ignition engines," *SAE Int'l J. Fuels Lubr.* 2017;10:442-60.
Mehl M et al., "An approach for formulating surrogates for gasoline with application toward a reduced surrogate mechanism for CFD engine modeling," *Energy Fuels* 2011;25:5215-23.
Mittal V et al., "The shift in relevance of fuel RON and MON to knock onset in modern SI engines over the last 70 years," *SAE Int'l J. Engines* 2010;2(2):1-10.
Monroe E et al., "Discovery of novel octane hyperboosting phenomenon in prenol biofuel/gasoline blends," *Fuel* 2019;239:1143-8.

(Continued)

*Primary Examiner* — Ellen M McAvoy
*Assistant Examiner* — Chantel L Graham
(74) *Attorney, Agent, or Firm* — Helen S. Baca

(57) ABSTRACT

The present invention relates, in part, to fuel mixtures and methods of preparing such mixtures. In particular, the mixture includes an alkenol additive that provides octane boosting.

20 Claims, 4 Drawing Sheets

(56) References Cited

OTHER PUBLICATIONS

Monroe E et al., Appendix A, Supplementary Data for "Discovery of novel octane hyperboosting phenomenon in prenol biofuel/gasoline blends," *Fuel* 2019;239:1143-8 (18 pp.).
Morganti KJ et al., "The Research and Motor Octane Numbers of Liquefied Petroleum Gas (LPG)," *Fuel* 2013;108:797-811.
Mueller CJ et al., "Diesel surrogate fuels for engine testing and chemical-kinetic modeling: compositions and properties," *Energy Fuels* 2016;30:1445-61.
Nriagu JO, "The rise and fall of leaded gasoline," *Sci. Total Environ.* 1990;92:13-28.
Pan J et al., "Research on in-cylinder pressure oscillation characteristic during knocking combustion in spark-ignition engine," *Fuel* 2014;120:150-7.
Park S et al., "Combustion characteristics of $C_5$ alcohols and a skeletal mechanism for homogeneous charge compression ignition combustion simulation," *Energy Fuels* 2015;29:7584-94.
Solomon BD et al., "Grain and cellulosic ethanol: history, economics, and energy policy," *Biomass Bioenerg.* 2007;31:416-25.
Splitter D et al., "A historical analysis of the co-evolution of gasoline octane number and spark-ignition engines," *Front. Mech. Eng.* 2016;1:Art. 16 (22 pp.).
Squillace PJ et al., "Preliminary assessment of the occurrence and possible sources of MTBE in groundwater in the United States, 1993-1994," *Environ. Sci. Technol.* 1996;30:1721-30.
Stein RA et al., "Effect of heat of vaporization, chemical octane, and sensitivity on knock limit for ethanol—gasoline blends," *SAE Int'l J. Fuels Lubr.* 2012;5:823-43.
Stradling R et al., "Effect of octane on performance, energy consumption and emissions of two Euro 4 passenger cars," *Transport. Res. Procedia* 2016;14:3159-68.
Szybist JP et al., "Understanding chemistry-specific fuel differences at a constant RON in a boosted SI engine," *Fuel* 2018;217:370-81.
Vuilleumier D et al., "The use of transient operation to evaluate fuel effects on knock limits well beyond RON Conditions in spark-ignition engines," *SAE Technical Paper* No. 2017-01-2234, 2017 (14 pp).
Wallner T et al., "Analytical assessment of C2-C8 alcohols as spark-ignition engine fuels," *Proceedings of the FISITA 2012 World Automotive Congress* (Society of Automotive Engineers of China (SAE—China) and International Federation of Automotive Engineering Societies (FISITA), eds.), Springer-Verlag Berlin Heidelberg, Germany, 2013, pp. 15-26.
Wang Z et al., "Knocking combustion in spark-ignition engines," *Prog. Energy Combustion Sci.* 2017;61:78-112.
Westbrook CK et al., "Chemical kinetics of octane sensitivity in a spark-ignition engine," *Combust. Flame* 2017;175:2-15.
Westbrook CK et al., "A new chemical kinetic method of determining RON and MON values for single component and multicomponent mixtures of engine fuels," *Combust. Flame* 2018;195:50-62.
Zheng Y et al., "Metabolic engineering of *Escherichia coli* for high-specificity production of isoprenol and prenol as next generation of biofuels," *Biotechnol. Biofuels* 2013;6:57 (13 pp.).

* cited by examiner

OCTANE HYPERBOOSTING IN FUEL BLENDS

CROSS-REFERENCE TO RELATED APPLICATION

This application claims the benefit of U.S. Provisional Application No. 62/685,141, filed Jun. 14, 2018, and U.S. Provisional Application No. 62/748,630, filed Oct. 22, 2018, each which is hereby incorporated by reference in its entirety.

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD OF THE INVENTION

The present invention relates, in part, to fuel mixtures and methods of preparing such mixtures. In particular, the mixture includes an alkenol additive that provides octane boosting.

BACKGROUND OF THE INVENTION

Fuel chemistry can be designed to enhance engine performance, fuel stability, and octane content. In one instance, additives can be included to provide such beneficial properties, but the identification of such additives and their properties still remains a challenge. Accordingly, there is a need for new fuel additives and fuel mixtures that display improved properties.

SUMMARY OF THE INVENTION

The present invention provides, in part, fuel additives that provide enhanced Research Octane Number (RON) values. An increased RON indicates a higher octane fuel having improved resistance to autoignition. Generally, the RON of a fuel mixture does not exceed the RON of its individual components. Thus, when an additive is included within the fuel, it is assumed that the RON of a mixture will never exceed the bounds of the RON for the additive. Herein, we describe fuel additives that provide RON enhancements, in which the RON of the fuel mixture exceeds that of the base fuel and the additive. In some embodiments, the additive is prenol and/or isoprenol, and RON enhancements were observed at prenol/isoprenol blending concentrations more than about 10% (w/w). In other embodiments, RON enhancements were observed at prenol/isoprenol blending concentrations more than about 15% (v/v).

In a first aspect, the present invention features a fuel mixture including: a fuel (e.g., a base fuel); an optional ethanol additive (e.g., in an amount of from about 5% (v/v) to about 50% (v/v)); and an alkenol additive. In some embodiments, the alkenol additive is present in an amount of from about 15% (v/v) to about 95% (v/v) (e.g., as determined by a percentage of the volume of the alkenol additive in a volume of the fuel). Exemplary amounts of the alkenol additive includes of about 15% (v/v) to 20% (v/v), 15% (v/v) to 30% (v/v), 15% (v/v) to 40% (v/v), 15% (v/v) to 50% (v/v), 15% (v/v) to 60% (v/v), 15% (v/v) to 70% (v/v), 15% (v/v) to 80% (v/v), 15% (v/v) to 85% (v/v), 15% (v/v) to 90% (v/v), 15% (v/v) to 95% (v/v), 20% (v/v) to 30% (v/v), 20% (v/v) to 40% (v/v), 20% (v/v) to 50% (v/v), 20% (v/v) to 60% (v/v), 20% (v/v) to 70% (v/v), 20% (v/v) to 80% (v/v), 20% (v/v) to 85% (v/v), 20% (v/v) to 90% (v/v), 20% (v/v) to 95% (v/v), 25% (v/v) to 30% (v/v), 25% (v/v) to 40% (v/v), 25% (v/v) to 50% (v/v), 25% (v/v) to 60% (v/v), 25% (v/v) to 70% (v/v), 25% (v/v) to 80% (v/v), 25% (v/v) to 85% (v/v), 25% (v/v) to 90% (v/v), 25% (v/v) to 95% (v/v), 30% (v/v) to 40% (v/v), 30% (v/v) to 50% (v/v), 30% (v/v) to 60% (v/v), 30% (v/v) to 70% (v/v), 30% (v/v) to 80% (v/v), 30% (v/v) to 85% (v/v), 30% (v/v) to 90% (v/v), 30% (v/v) to 95% (v/v), 35% (v/v) to 40% (v/v), 35% (v/v) to 50% (v/v), 35% (v/v) to 60% (v/v), 35% (v/v) to 70% (v/v), 35% (v/v) to 80% (v/v), 35% (v/v) to 85% (v/v), 35% (v/v) to 90% (v/v), 35% (v/v) to 95% (v/v), 40% (v/v) to 50% (v/v), 40% (v/v) to 60% (v/v), 40% (v/v) to 70% (v/v), 40% (v/v) to 80% (v/v), 40% (v/v) to 85% (v/v), 40% (v/v) to 90% (v/v), 40% (v/v) to 95% (v/v), 45% (v/v) to 50% (v/v), 45% (v/v) to 60% (v/v), 45% (v/v) to 70% (v/v), 45% (v/v) to 80% (v/v), 45% (v/v) to 85% (v/v), 45% (v/v) to 90% (v/v), 45% (v/v) to 95% (v/v), 50% (v/v) to 60% (v/v), 50% (v/v) to 70% (v/v), 50% (v/v) to 80% (v/v), 50% (v/v) to 85% (v/v), 50% (v/v) to 90% (v/v), 50% (v/v) to 95% (v/v), 55% (v/v) to 60% (v/v), 55% (v/v) to 70% (v/v), 55% (v/v) to 80% (v/v), 55% (v/v) to 85% (v/v), 55% (v/v) to 90% (v/v), 55% (v/v) to 95% (v/v), 60% (v/v) to 70% (v/v), 60% (v/v) to 80% (v/v), 60% (v/v) to 85% (v/v), 60% (v/v) to 90% (v/v), 60% (v/v) to 95% (v/v), 65% (v/v) to 70% (v/v), 65% (v/v) to 80% (v/v), 65% (v/v) to 85% (v/v), 65% (v/v) to 90% (v/v), 65% (v/v) to 95% (v/v), 70% (v/v) to 80% (v/v), 70% (v/v) to 85% (v/v), 70% (v/v) to 90% (v/v), 70% (v/v) to 95% (v/v), 75% (v/v) to 80% (v/v), 75% (v/v) to 90% (v/v), 75% (v/v) to 95% (v/v), 80% (v/v) to 85% (v/v), 80% (v/v) to 90% (v/v), 80% (v/v) to 95% (v/v), 85% (v/v) to 90% (v/v), 85% (v/v) to 95% (v/v), and 90% (v/v) to 95% (v/v).

In some embodiments, the alkenol additive is present in an amount of from about 10% (w/w) to about 95% (w/w) (e.g., 10% (w/w) to 15% (w/w), 10% (w/w) to 20% (w/w), 10% (w/w) to 30% (w/w), 10% (w/w) to 40% (w/w), 10% (w/w) to 50% (w/w), 10% (w/w) to 60% (w/w), 10% (w/w) to 70% (w/w), 10% (w/w) to 80% (w/w), 10% (w/w) to 90% (w/w), 15% (w/w) to 20% (w/w), 15% (w/w) to 30% (w/w), 15% (w/w) to 40% (w/w), 15% (w/w) to 50% (w/w), 15% (w/w) to 60% (w/w), 15% (w/w) to 70% (w/w), 15% (w/w) to 80% (w/w), 15% (w/w) to 90% (w/w), 15% (w/w) to 95% (w/w), 20% (w/w) to 30% (w/w), 20% (w/w) to 40% (w/w), 20% (w/w) to 50% (w/w), 20% (w/w) to 60% (w/w), 20% (w/w) to 70% (w/w), 20% (w/w) to 80% (w/w), 20% (w/w) to 90% (w/w), 20% (w/w) to 95% (w/w), 25% (w/w) to 30% (w/w), 25% (w/w) to 40% (w/w), 25% (w/w) to 50% (w/w), 25% (w/w) to 60% (w/w), 25% (w/w) to 70% (w/w), 25% (w/w) to 80% (w/w), 25% (w/w) to 90% (w/w), 25% (w/w) to 95% (w/w), 30% (w/w) to 40% (w/w), 30% (w/w) to 50% (w/w), 30% (w/w) to 60% (w/w), 30% (w/w) to 70% (w/w), 30% (w/w) to 80% (w/w), 30% (w/w) to 90% (w/w), 30% (w/w) to 95% (w/w), 35% (w/w) to 40% (w/w), 35% (w/w) to 50% (w/w), 35% (w/w) to 60% (w/w), 35% (w/w) to 70% (w/w), 35% (w/w) to 80% (w/w), 35% (w/w) to 90% (w/w), 35% (w/w) to 95% (w/w), 40% (w/w) to 50% (w/w), 40% (w/w) to 60% (w/w), 40% (w/w) to 70% (w/w), 40% (w/w) to 80% (w/w), 40% (w/w) to 90% (w/w), 40% (w/w) to 95% (w/w), 45% (w/w) to 50% (w/w), 45% (w/w) to 60% (w/w), 45% (w/w) to 70% (w/w), 45% (w/w) to 80% (w/w), 45% (w/w) to 90% (w/w), 45% (w/w) to 95% (w/w), 50% (w/w) to 60% (w/w), 50% (w/w) to 70% (w/w), 50% (w/w) to 80% (w/w), 50% (w/w) to 90% (w/w), 50% (w/w) to 95% (w/w), 55% (w/w) to 60% (w/w), 55% (w/w) to 70% (w/w), 55%

(w/w) to 80% (w/w), 55% (w/w) to 90% (w/w), 55% (w/w) to 95% (w/w), 60% (w/w) to 70% (w/w), 60% (w/w) to 80% (w/w), 60% (w/w) to 90% (w/w), 60% (w/w) to 95% (w/w), 65% (w/w) to 70% (w/w), 65% (w/w) to 80% (w/w), 65% (w/w) to 90% (w/w), 65% (w/w) to 95% (w/w), 70% (w/w) to 80% (w/w), 70% (w/w) to 90% (w/w), 70% (w/w) to 95% (w/w), 75% (w/w) to 80% (w/w), 75% (w/w) to 90% (w/w), 75% (w/w) to 95% (w/w), 80% (w/w) to 90% (w/w), 80% (w/w) to 95% (w/w), 85% (w/w) to 90% (w/w), 85% (w/w) to 95% (w/w), and 90% (w/w) to 95% (w/w).

In a second aspect, the present invention features a fuel mixture including: a fuel; an optional ethanol additive (e.g., in an amount of from about 5% (v/v) to about 50% (v/v)); and an isopentenol. In some embodiments, the isopentenol is present in an amount of from about 15% (v/v) to about 95% (v/v) (e.g., including any ranges described herein) and/or of from about 10% (w/w) to about 95% (w/w) (e.g., including any ranges described herein). In other embodiments, the fuel includes a reformulated blendstock for oxygenated blending and/or a biofuel. In yet other embodiments, the isopentenol is present in an amount of from about 30% (v/v) to about 85% (v/v). In other embodiments, the isopentenol is prenol, isoprenol, and/or an isomer thereof.

In a third aspect, the present invention features a method of preparing a fuel mixture including a fuel additive. In some embodiments, the method includes: blending an alkenol additive into a fuel, thereby providing a fuel mixture including the alkenol additive. In other embodiments, the alkenol additive is present in an amount of from about 15% (v/v) to about 95% (v/v) (e.g., including any ranges described herein) and/or of from about 10% (w/w) to about 95% (w/w) (e.g., including any ranges described herein).

In some embodiments, the method includes (e.g., before the blending step): purifying the alkenol additive by removing one or more polar contaminants, thereby providing a purified alkenol additive. In other embodiments, the purified alkenol additive does not include a peroxide or a hydrate.

In some embodiments, the method includes (e.g., after the blending step): determining a RON of the fuel mixture that is greater than a RON of the alkenol additive.

In any embodiment herein, the fuel is selected from the group consisting of a gasoline, a biofuel, a blendstock, a hydrocarbon, and a combination thereof. In other embodiments, the fuel is selected from the group of conventional gasoline, oxygenated gasoline, reformulated gasoline, biofuel, biogasoline, biodiesel, Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), gasoline treated as blendstock (GTAB), crude oil, fuel oil, distillate fuel oil, diesel fuel, jet fuel, petroleum, a combination thereof, or any other described herein. In yet other embodiments, the fuel includes an alkylate, a paraffin, an olefin, a reformate, a naphthene, a ketone, an aromatic, a combination thereof, or any other described herein.

In any embodiment herein, the alkenol additive includes an optionally substituted $C_{1-10}$ alkenol (e.g., as defined herein). In some embodiments, the alkenol additive includes an optionally substituted branched $C_{1-10}$ alkenol). In other embodiments, the alkenol additive includes an optionally substituted pentenol (e.g., a $C_5$-alkenol that is branched or linear) or an optionally substituted isopentenol (e.g., a branched $C_5$-alkenol). In yet other embodiments, the alkenol additive includes prenol and/or isoprenol, as well as isomers thereof.

In any embodiment herein, the fuel mixture includes butane, pentane, heptane, octane, hexene, toluene, or a combination thereof.

In any embodiment herein, a RON of the fuel mixture is greater than a RON of the alkenol additive.

Definitions

As used herein, the term "about" means+/−10% of any recited value. As used herein, this term modifies any recited value, range of values, or endpoints of one or more ranges.

By "alkenol" is meant an optionally substituted alkenyl group, as defined herein, substituted by one or more hydroxyl groups, as defined herein. Exemplary alkenols include $R^A$—OH, where $R^A$ is optionally substituted alkenyl (e.g., optionally substituted $C_{2-24}$, $C_{2-22}$, $C_{2-20}$, $C_{2-18}$, $C_{2-16}$, $C_{2-14}$, $C_{2-12}$, $C_{2-10}$, $C_{2-9}$, $C_{2-8}$, $C_{2-7}$, $C_{2-6}$, $C_{2-5}$, or $C_{2-4}$ alkenyl group). Further exemplary alkenols include prenol (3-methyl-2-buten-1-ol), isoprenol (3-methyl-3-buten-1-ol), 2-methyl-3-buten-2-ol, as well as any described herein. Yet another alkenol includes an optionally substituted pentenol (e.g., a $C_5$ alkenol) that can be linear or branched.

By "alkenyl" is meant an optionally substituted $C_{2-24}$ alkyl group, as defined herein, having one or more double bonds. The alkenyl group can be cyclic (e.g., $C_{3-24}$ cycloalkenyl) or acyclic. The alkenyl group can also be substituted or unsubstituted. For example, the alkenyl group can be substituted with one or more substitution groups, as described herein for alkyl.

By "alkyl" and the prefix "alk" is meant a branched or unbranched saturated hydrocarbon group of 1 to 24 carbon atoms, such as methyl, ethyl, n-propyl, isopropyl, n-butyl, isobutyl, s-butyl, t-butyl, n-pentyl, isopentyl, s-pentyl, neopentyl, hexyl, heptyl, octyl, nonyl, decyl, dodecyl, tetradecyl, hexadecyl, eicosyl, tetracosyl, and the like. The alkyl group can be cyclic (e.g., $C_{3-24}$ cycloalkyl) or acyclic. The alkyl group can be branched or unbranched. The alkyl group can also be substituted or unsubstituted. For example, the alkyl group can be substituted with one, two, three or, in the case of alkyl groups of two carbons or more, four substituents independently selected from the group consisting of. (1) $C_{1-6}$ alkoxy (e.g., —OAk, in which Ak is an alkyl group, as defined herein); (2) $C_{1-6}$ alkylsulfinyl (e.g., —S(O)Ak, in which Ak is an alkyl group, as defined herein); (3) $C_{1-6}$ alkylsulfonyl (e.g., —$SO_2$Ak, in which Ak is an alkyl group, as defined herein); (4) amino (e.g., —$NR^{N1}R^{N2}$, where each of $R^{N1}$ and $R^{N2}$ is, independently, H or optionally substituted alkyl, or $R^{N1}$ and $R^{N2}$, taken together with the nitrogen atom to which each are attached, form a heterocyclyl group); (5) aryl; (6) arylalkoxy (e.g., —$OA^LAr$, in which $A^L$ is an alkylene group and Ar is an aryl group, as defined herein); (7) aryloyl (e.g., —C(O)Ar, in which Ar is an aryl group, as defined herein); (8) azido (e.g., an —$N_3$ group); (9) cyano (e.g., a —CN group); (10) carboxyaldehyde (e.g., a —C(O)H group); (11) $C_{3-8}$ cycloalkyl; (12) halo; (13) heterocyclyl (e.g., a 5-, 6- or 7-membered ring, unless otherwise specified, containing one, two, three, or four non-carbon heteroatoms (e.g., independently selected from the group consisting of nitrogen, oxygen, phosphorous, sulfur, or halo)); (14) heterocyclyloxy (e.g., —OHet, in which Het is a heterocyclyl group); (15) heterocyclyloyl (e.g., —C(O) Het, in which Het is a heterocyclyl group); (16) hydroxyl (e.g., a —OH group); (17) N-protected amino; (18) nitro (e.g., an —$NO_2$ group); (19) oxo (e.g., an =O group); (20) $C_{3-8}$ spirocyclyl (e.g., an alkylene diradical, both ends of which are bonded to the same carbon atom of the parent group to form a spirocyclyl group); (21) $C_{1-6}$ thioalkoxy (e.g., —SAk, in which Ak is an alkyl group, as defined herein); (22) thiol (e.g., an —SH group); (23) —$CO_2R^A$, where $R^A$ is selected from the group consisting of (a) hydrogen, (b) $C_{1-6}$ alkyl, (c) $C_{4-18}$ aryl, and (d) $C_{1-6}$ alk-$C_{4-18}$ aryl; (24) —C(O)$NR^BR^C$, where each of $R^B$ and $R^C$ is, independently, selected from the group consisting of (a) hydrogen, (b) $C_{1-6}$ alkyl, (c) $C_{4-18}$ aryl, and (d) $C_{1-6}$ alk-$C_{4-18}$ aryl; (25) —$SO_2R^D$, where $R^D$ is selected from the group consisting of (a) $C_{1-6}$ alkyl, (b) $C_{4-18}$ aryl, and (c) $C_{1-6}$ alk-$C_{4-18}$ aryl; (26) —$SO_2NR^ER^F$, where each of $R^E$ and $R^F$ is, independently, selected from the group consisting of (a) hydrogen, (b) $C_{1-6}$ alkyl, (c) $C_{4-18}$ aryl, and (d) $C_{1-6}$ alk-$C_{4-18}$ aryl; (27) —$NR^GR^H$, where each of $R^G$ and $R^H$ is, independently, selected from the group consisting of (a) hydrogen, (b) an N-protecting group, (c) $C_{1-6}$ alkyl, (d) $C_{2-6}$ alkenyl, (e) $C_{2-6}$ alkynyl, (f) $C_{4-18}$ aryl, (g) $C_{1-6}$ alk-$C_{4-18}$ is aryl, (h) $C_{3-8}$ cycloalkyl, and (i) $C_{1-6}$ alk-$C_{3-8}$ cycloalkyl, wherein in one embodiment no two groups are bound to the nitrogen atom through a carbonyl group or a sulfonyl group; and (28) $C_{1-6}$ carbene (e.g., methylene (=$CH_2$ or >$CH_2$), ethenylidene (=C=$CH_2$ or >C=$CH_2$), prop-2-en-1-ylidene (=CHCH=$CH_2$ or >CHCH=$CH_2$), or cyclohexylidene). The alkyl group can be a primary, secondary, or tertiary alkyl group substituted with one or more substituents (e.g., one or more halo or alkoxy). In some embodiments, the unsubstituted alkyl group is a $C_{1-3}$, $C_{1-6}$, $C_{1-12}$, $C_{1-16}$, $C_{1-18}$, $C_{1-20}$, or $C_{1-24}$ alkyl group.

By "hydroxyl" is meant —OH.

Other features and advantages of the invention will be apparent from the following description and the claims.

DETAILED DESCRIPTION OF THE INVENTION

Figure 1:
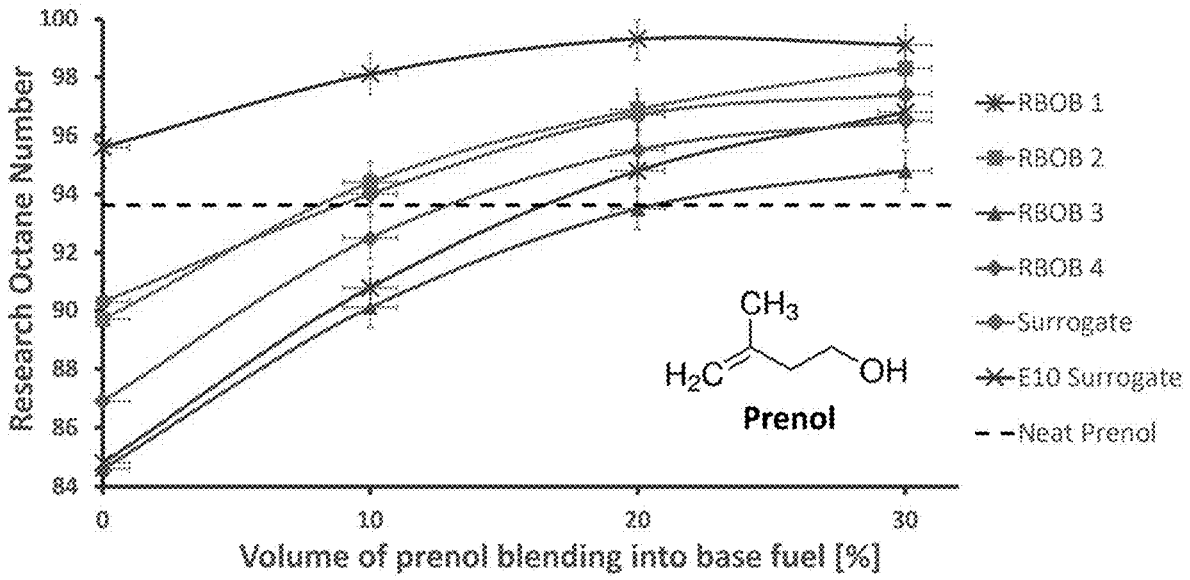
FIG. 1 is a graph shows the Research Octane Number (RON) of prenol blended into six different gasoline mixtures along with the structure of prenol. Each of the mixtures except RBOB 3 shows blended RON values greater than the neat RON of prenol by the 20% volume fraction, with the surrogate and RBOB 2 showing hyperboosting at just 10% by volume. The highest blended RON that was achieved was 98.3, which is 4.8 RON points higher than prenol's neat RON value. The ordinate error bars represent the 0.7 ON reproducibility within this range of the RON test (ASTM International, "Standard test method for Research Octane Number of spark-ignition engine fuel," Designation No. ASTMD2699-16, West Conshohocken, Pa., 2016), and the abscissa error bars represent 1.4% volume error.

The present invention relates, in part, to fuel mixtures including an alkenol additive. In particular embodiments, we provide synergistic blending regimes for oxygenate fuels, which may be identified for increasing the efficiency of spark ignition engines, especially in high compression regimes. Such regimes were identified by screening of a variety of high performance fuels candidates in the presence of neat fuel components or as blends, as well as evaluating RON and octane sensitivity impacts. In non-limiting embodiments, prenol was found to have a RON of 94 as a neat compound but a RON of up to 98 for blends in RBOB or 4-component gasoline surrogates at low volume fractions (~15%-30%). Additional details follow.

Fuels and Fuel Mixture

Any useful component can be present within the fuel or the fuel mixture. The fuel can be a neat fuel or a blended fuel. Such blended fuels can include two or more chemical components (e.g., any described herein). In particular embodiments, the fuel mixture includes one or more chemical components (or blendstocks) in combination with an alkenol additive (e.g., any described herein). In some embodiments, the fuel or fuel mixture includes one or more components that are volatile and suitable for use in spark ignition engines and/or advanced compression ignition engines.

Exemplary fuels and fuel mixtures can include any chemical component, including, e.g., an alkylate (e.g., isoparaffin), a paraffin (e.g., normal paraffins, iso-paraffins), an olefin (e.g., butylene, such as di-isobutylene, and a pentene (e.g., 2,4,4-trimethyl-1-pentene and/or 2,4,4-trimethyl-2-pentene)), a reformate (e.g., aromatics), a naptha (e.g., n-, iso-, cyclo-paraffin), a naphthene (e.g., cycloparaffins), a ketone (e.g., butanone (e.g., 3-methyl-2-butanone), pentanone (e.g., 2-pentanone, 3-pentanone, 4-methyl-2-pentanone, 2,4-dimethyl-3-pentanone, and cyclopentanone), hexanone, a cyclic ketone (e.g., cyclopentanone) or a ketone mixture), an aromatic (e.g., single ring and multi-ring aromatics, such as toluene), an alcohol (e.g., methanol, ethanol, propanol (e.g., 1-propanol and iso-propanol), butanol (e.g., 1-butanol, 2-butanol, iso-butanol, and 2-methylbutan-1-ol), and pentanol (e.g., 2-pentanol)), an alkene (e.g., a butylene (e.g., such as di-isobutylene), hexene (e.g., 1-hexene), etc.), an alkane (e.g., a branched alkane, such as 2,2,3-trimethylbutane; and butane (e.g., n-butane), pentane, heptane (e.g., n-heptane), octane (e.g., iso-octane), etc.), a fatty acid (including esters thereof, e.g., simple fatty acid esters and/or volatile fatty acid esters), a fatty ester, a furan (e.g., 2,5-dimethylfuran, 2-methylfuran, and combinations thereof), an ether (e.g., anisole), an ester (e.g., an acetate (e.g., methyl acetate, ethyl acetate, iso-propyl acetate, butyl acetate, 2-methylpropyl acetate, and 3-methylpropyl acetate), a butanoate (e.g., methyl butanoate, methyl isobutanoate, methyl-2-methylbutanoate, ethyl butanoate, and ethyl isobutanoate), a pentanoate (e.g., methyl pentanoate), and mixed esters), an oxygenate (e.g., an alcohol including a polyol, such as propanol (e.g., 1- or 2-propanol), ethanol, butanol (e.g., 1- or 2-butanol), diol (e.g., 1,3-propanediol and 2,3-butanediol), triol (e.g., glycerol); or a carboxylic acid (e.g., acetic acid)), an aldehyde (e.g., prenal), a carboxylic acid, a multicomponent mixture (e.g., methanol-to-gasoline, ethanol-to-gasoline, bioreformate via multistage pyrolysis, bioreformate via catalytic conversion of sugar, mixed aromatics via catalytic fast pyrolysis, and aromatics and olefins via pyrolysis-derived sugars), as well as combinations and/or isomers of any of these. Each of these chemical components can be present in the fuel, as well as employed as a blending component with other oxygenate(s) and/or fuel(s) to provide a finished fuel product having desired fuel standards.

Exemplary fuels and fuel mixtures also include conventional gasoline, oxygenated gasoline, reformulated gasoline, biofuel (e.g., a fuel derived from a biomass containing biological material, such as those including plants, plant-derived materials, bacteria, fungi, and/or algae), biogasoline, biodiesel, bioblendstock (including component(s) produced from biomass, e.g., components such as cellulosic ethanol, methanol, butanol, triptane-rich blend, mixed aromatics, mixed ketones, an iso-olefin mixture, etc.), Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), CARBOB (an RBOB suitable for use in California as regulated by the California Air Resources Board), gasoline treated as blendstock (GTAB), crude oil, fuel oil, distillate fuel oil, diesel fuel, jet fuel, petroleum, a natural gas liquid (e.g., any isomer and combination of methane, ethane, propane, butane, pentane, hexane, heptane, as well as higher molecular weight hydrocarbons, and mixtures thereof), a hydrocarbon (e.g., any described herein), a surrogate fuel (e.g., octane (e.g., iso-octane), toluene, heptane, or hexene (e.g., 1-hexene)), a core fuel (e.g., alkylate, E30 (a blend of 30% ethanol in fuel component(s)), aromatics, cycloparaffins, and olefins), and combinations thereof.

In some embodiments, the fuel includes a surrogate fuel. An exemplary surrogate fuel (e.g., surrogate gasoline) can include octane (e.g., iso-octane) and heptane (e.g., n-heptane). Another exemplary surrogate fuel (e.g., surrogate gasoline) can include octane (e.g., iso-octane), heptane (e.g., n-heptane), toluene, and hexene (e.g., 1-hexene) (e.g., iso-octane (55 vol %), n-heptane (15 vol %), toluene (25 vol %), and 1-hexene (5 vol %)). Yet another exemplary surrogate fuel (e.g., surrogate jet fuel) can include decane, dodecane, methylcyclohexane, and toluene. another exemplary surrogate fuel (e.g., surrogate diesel) can include hexadecane. Another exemplary surrogate fuel (e.g., surrogate biodiesel) can include methyl butyrate and methyl decanoate.

In particular embodiments, the fuel includes component (s) obtained from processing a biomass (e.g., oil crops, algae, yeast, bacteria, etc.). Exemplary components from such biomass can include alcohols, aldehydes, aromatics, carboxylic acids, cyclic fatty acids, esters, ethers, fatty acid esters, furanics, isoprenoids, ketones, naphthenics, olefins, polyketides, terpenes, etc.

Fuels and fuel mixtures, including blendstocks, optionally may include other chemicals and additives to adjust properties of the fuel and/or to facilitate fuel preparation. Examples of such chemicals or additives include detergents, antioxidants, stability enhancers, demulsifiers, corrosion inhibitors, metal deactivators, antiknock additives, valve seat recession protectant compounds, dyes, diluents, friction modifiers, markers, solvents, carrier solutions (e.g., mineral oil, alcohols, carboxylic acids, synthetic oils, etc.), etc. More than one additive or chemical can be used.

Alkenol Additive

The fuel mixture can include one or more alkenol additives. In particular embodiments, the alkenol additive includes an optionally substituted $C_{1-10}$ alkenol (e.g., as defined herein). The alkenol can include a linear carbon backbone or a branched carbon backbone. Exemplary alkenol additives includes pentenol, isopentenol, prenol, and/or isoprenol. The alkenol additive may be present in any useful amount (e.g., any percentage (v/v) and/or (w/w) described herein). In some embodiments, the alkenol additive is present in an amount such that a RON of the fuel mixture is greater than the individual RON of the base fuel and the individual RON of the alkenol additive. Methods of determining RON are known, e.g., see ASTM International, "Standard test method for Research Octane Number of spark-ignition engine fuel," Designation No. ASTMD2699-16, West Conshohocken, Pa., 2016; and see ASTM International, "Standard test method for Research Octane Number of spark-ignition engine fuel," Designation No. ASTM D2699-18, West Conshohocken, Pa., 2018.

In particular embodiments, the fuel mixture includes two or more alkenol additives. In one embodiment, the fuel mixture can include an optionally substituted $C_{1-10}$ alkenol having a branched carbon backbone (e.g., prenol) and an optionally substituted $C_{1-10}$ alkenol having a linear backbone (e.g., ethanol). In another embodiment, the fuel mixture can include a first optionally substituted $C_{1-10}$ alkenol additive (e.g., having a branched carbon backbone, such as prenol) and a second optionally substituted $C_{1-10}$ alkenol additive (e.g., having a linear backbone, such as ethanol), wherein the first and second alkenol additives are different.

In some embodiments, the fuel mixture includes of from about 5% (v/v) to about 95% (v/v) of the first alkenol additive and of from about 5% (v/v) to about 95% (v/v) of the second alkenol additive. Non-limiting amounts of the first alkenol additive and/or the second alkenol additive can include of from about 5% (v/v) to about 95% (v/v) (e.g., 5% (v/v) to 10% (v/v), 5% (v/v) to 15% (v/v), 5% (v/v) to 20% (v/v), 5% (v/v) to 30% (v/v), 5% (v/v) to 40% (v/v), 5% (v/v) to 50% (v/v), 5% (v/v) to 60% (v/v), 5% (v/v) to 70% (v/v), 5% (v/v) to 80% (v/v), 5% (v/v) to 90% (v/v), 10% (v/v) to 15% (v/v), 10% (v/v) to 20% (v/v), 10% (v/v) to 30% (v/v), 10% (v/v) to 40% (v/v), 10% (v/v) to 50% (v/v), 10% (v/v) to 60% (v/v), 10% (v/v) to 70% (v/v), 10% (v/v) to 80% (v/v), 10% (v/v) to 90% (v/v), 10% (v/v) to 95% (v/v), 15% (v/v) to 20% (v/v), 15% (v/v) to 30% (v/v), 15% (v/v) to 40% (v/v), 15% (v/v) to 50% (v/v), 15% (v/v) to 60% (v/v), 15% (v/v) to 70% (v/v), 15% (v/v) to 80% (v/v), 15% (v/v) to 90% (v/v), 15% (v/v) to 95% (v/v), 20% (v/v) to 30% (v/v), 20% (v/v) to 40% (v/v), 20% (v/v) to 50% (v/v), 20% (v/v) to 60% (v/v), 20% (v/v) to 70% (v/v), 20% (v/v) to 80% (v/v), 20% (v/v) to 90% (v/v), 20% (v/v) to 95% (v/v), 25% (v/v) to 30% (v/v), 25% (v/v) to 40% (v/v), 25% (v/v) to 50% (v/v), 25% (v/v) to 60% (v/v), 25% (v/v) to 70% (v/v), 25% (v/v) to 80% (v/v), 25% (v/v) to 90% (v/v), 25% (v/v) to 95% (v/v), 30% (v/v) to 40% (v/v), 30% (v/v) to 50% (v/v), 30% (v/v) to 60% (v/v), 30% (v/v) to 70% (v/v), 30% (v/v) to 80% (v/v), 30% (v/v) to 90% (v/v), 30% (v/v) to 95% (v/v), 35% (v/v) to 40% (v/v), 35% (v/v) to 50% (v/v), 35% (v/v) to 60% (v/v), 35% (v/v) to 70% (v/v), 35% (v/v) to 80% (v/v), 35% (v/v) to 90% (v/v), 35% (v/v) to 95% (v/v), 40% (v/v) to 50% (v/v), 40% (v/v) to 60% (v/v), 40% (v/v) to 70% (v/v), 40% (v/v) to 80% (v/v), 40% (v/v) to 90% (v/v), 40% (v/v) to 95% (v/v), 45% (v/v) to 50% (v/v), 45% (v/v) to 60% (v/v), 45% (v/v) to 70%

(v/v), 45% (v/v) to 80% (v/v), 45% (v/v) to 90% (v/v), 45% (v/v) to 95% (v/v), 50% (v/v) to 60% (v/v), 50% (v/v) to 70% (v/v), 50% (v/v) to 80% (v/v), 50% (v/v) to 90% (v/v), 50% (v/v) to 95% (v/v), 55% (v/v) to 60% (v/v), 55% (v/v) to 70% (v/v), 55% (v/v) to 80% (v/v), 55% (v/v) to 90% (v/v), 55% (v/v) to 95% (v/v), 60% (v/v) to 70% (v/v), 60% (v/v) to 80% (v/v), 60% (v/v) to 90% (v/v), 60% (v/v) to 95% (v/v), 65% (v/v) to 70% (v/v), 65% (v/v) to 80% (v/v), 65% (v/v) to 90% (v/v), 65% (v/v) to 95% (v/v), 70% (v/v) to 80% (v/v), 70% (v/v) to 90% (v/v), 70% (v/v) to 95% (v/v), 75% (v/v) to 80% (v/v), 75% (v/v) to 90% (v/v), 75% (v/v) to 95% (v/v), 80% (v/v) to 90% (v/v), 80% (v/v) to 95% (v/v), 85% (v/v) to 90% (v/v), 85% (v/v) to 95% (v/v), and 90% (v/v) to 95% (v/v).

Methods

The present invention also relates to methods of preparing a fuel mixture (e.g., any described herein). In one instance, the method includes blending an alkenol additive into a fuel, thereby providing a fuel mixture including the alkenol additive in an amount of from about 15% (v/v) to about 95% (v/v) and/or about 10% (w/w) to about 95% (w/w). Such blending can occur by volume and/or weight of the solute, solvent, and/or solution.

In some embodiments, the method includes purifying the alkenol additive to provide a purified alkenol additive, which can then be employed during blending. In one instance, purifying includes removing one or more contaminations, such as polar contaminants (e.g. peroxides and/or hydrates).

In other embodiments, the method can include verifying the RON of the fuel mixture. In one embodiment, the method includes determining a RON of the fuel mixture that is greater than a RON of the alkenol additive. The RON values can be determined in any useful manner (e.g., any described herein).

EXAMPLES

Example 1: Discovery of Novel Octane Hyperboosting Phenomenon in Prenol Biofuel/Gasoline Blends Herein, we describe the first documented case, to our knowledge, of an effect defined herein as "octane hyperboosting" by an oxygenated biofuel, 3-methyl-2-buten-1-ol (prenol). Octane hyperboosting is characterized by the Research Octane Number (RON) of a mixture (e.g., an oxygenate biofuel blended into gasoline) exceeding the RON of the individual components in that mixture. This finding counters the widely held assumption that interpolation between the RON values of a pure compound and the base fuel provides the bounds for the RON performance of the mixture.

This understanding is clearly distinct from the more commonly observed synergistic blending of oxygenates with gasoline, where the RON never exceeds the performance of the highest performing component. For instance, octane hyperboosting was observed for blends of prenol and six different gasoline fuels with varying composition. Testing of compounds chemically similar to prenol yielded no qualitatively similar instances of octane hyperboosting, which suggests that the effect may not be widespread among fuel candidates. The phenomenon suggests an unexplored aspect of autoignition kinetics research for fuel blends and may provide a new mechanism for significantly increasing fuel octane number, which is necessary for increasing combustion efficiency in spark ignition engines. This phenomenon also increases the potential candidate list of high performance biofuels; potential fuels and compounds hitherto discounted due to their lower pure component RON may exhibit hyperboosting behavior and thereby enhance performance in blends. Additional details follow.

Example 2: Challenging the Assumptions Offuel Octane Metrics

The ability to accurately predict engine performance based on an understanding of basic fuel chemistry has been a major goal of combustion science and engineering since the advent of the internal combustion engine. As mid-to-low boiling range petroleum distillates became the standard raw material to power spark ignition (SI) combustion engines, a significant quantity of SI combustion research has focused on identifying fuel additives that could increase a fuel's ability to resist autoignition, and thereby prevent a phenomenon known as engine knock (see, e.g., Mittal V et al., "The shift in relevance of fuel RON and MON to knock onset in modern SI engines over the last 70 years," *SAE Int'l J. Engines* 2010; 2(2):1-10; and Wang Z et al., "Knocking combustion in spark-ignition engines," *Prog. Energy Combustion Sci.* 2017; 61:78-112).

Historically, additives such as tetra-ethyl lead (TEL) and methyl tert-butyl ether (MTBE) were used to minimize engine knock (e.g., Nriagu J O, "The rise and fall of leaded gasoline," *Sci. Total Environ.* 1990; 92:13-28). However, health and environmental risks associated with these additives resulted in each being phased out of the U.S. market, with ethanol becoming the dominant oxygenate and octane enhancer for gasoline blending by the mid-2000s (see, e.g., Solomon B D et al., "Grain and cellulosic ethanol: history, economics, and energy policy," *Biomass Bioenerg.* 2007; 31:416-25; and Squillace P J et al., "Preliminary assessment of the occurrence and possible sources of MTBE in groundwater in the United States, 1993-1994," *Environ. Sci. Technol.* 1996; 30:1721-30).

Resistance to autoignition is quantified by the octane rating, with Research Octane Number (RON) and Motor Octane Number (MON) ASTM tests having long been used as the two metrics to quantify a fuel's octane or antiknock performance (see, e.g., ASTM International, "Standard test method for Research Octane Number of spark-ignition engine fuel," Designation No. ASTMD2699-16, West Conshohocken, Pa., 2016; ASTM International, "Standard test method for Motor Octane Number of spark-ignition engine fuel," Designation No. ASTMD2700-16a, West Conshohocken Pa., 2016; and Splitter D et al., "A historical analysis of the co-evolution of gasoline octane number and spark-ignition engines," *Front. Mech. Eng.* 2016; 1:Art. 16 (22 pp.)). Increasing octane number could enable several efficiency improvement technologies to be implemented in SI engines including increased compression ratio, downsizing and downspeeding, and increased turbocharging, and reduction of carbon monoxide and soot (see, e.g., Inal F et al., "Effects of oxygenate additives on polycyclic aromatic hydrocarbons (PAHs) and soot formation," *Combustion Sci. Technol.* 2002; 174:1-19).

Beyond combustion efficiency, engine knock is associated with a host of issues negatively impacting spark ignition engine longevity, including piston melt, gasket leakage, cylinder bore scuffing, and cylinder head erosion (see, e.g., Heywood J B, "Internal combustion engine fundamentals," McGraw-Hill, Inc., New York, N.Y., 1988, 930 pp.). Clearly, the impact of higher octane fuels can be significant, with Heywood et al. reporting that if the RON of gasoline was globally raised to 98, overall greenhouse gas emissions would be 4.5-6% lower than the baseline case of lower octane gasoline (see, e.g., Chow E W et al., "Benefits of a higher octane standard gasoline for the U.S. light-duty vehicle fleet," *SAE Technical Paper No.* 2014-01-1961, 2014, 18 pp.). Other studies have demonstrated similar benefits of higher octane fuels (see, e.g., Stradling R et al., "Effect of octane on performance, energy consumption and emissions of two Euro 4 passenger cars," *Transport. Res. Procedia* 2016; 14:3159-68; and Pan J et al., "Research on in-cylinder pressure oscillation characteristic during knocking combustion in spark-ignition engine," Fuel 2014; 120: 150-7).

If the RON enhancement is due to a renewable bioderived fuel these benefits are further increased due to displacement of fossil fuels. Understanding the behavior of bioderived fuels in blends is of additional importance because, as with ethanol, it is anticipated that new biofuels will be added to a base fuel rather than used neat.

Numerous studies have been conducted to understand the RON and MON performance of both neat compounds and blended fuels (see, e.g., American Society for Testing Materials, "Knocking characteristics of pure hydrocarbons," *ASTM Special Technical Pub. No.* 225, Philadelphia, Pa., 1958; Ghosh P et al., "Development of a detailed gasoline composition-based octane model," *Ind. Eng. Chem. Res.* 2006; 45:337-45; Lovell W G, "Knocking characteristics of hydrocarbons," *Ind. Eng. Chem.* 1948; 40:2388-438; and Morganti K J et al., "The Research and Motor Octane Numbers of Liquefied Petroleum Gas (LPG)," *Fuel* 2013; 108:797-811). More recently efforts have focused on using first principles approaches, such as chemical kinetics to predict antiknock properties, however, these have been limited to low complexity fuel surrogates and computational modeling approaches (see, e.g., Boot M D et al., "Impact of fuel molecular structure on auto-ignition behavior-design rules for future high performance gasolines," *Prog. Energ. Combust. Sci.* 2017; 60:1-25; Bu L et al., "Understanding trends in autoignition of 15 biofuels: homologous series of oxygenated C5 molecules," *J. Phys. Chem. A* 2017; 121: 5475-86; Westbrook C K et al., "Chemical kinetics of octane sensitivity in a spark-ignition engine," *Combust. Flame* 2017; 175:2-15; Szybist J P et al., "Understanding chemistry-specific fuel differences at a constant RON in a boosted SI engine," *Fuel* 2018; 217:370-81; Maylin M V et al., "Calculation of gasoline octane numbers taking into account the reaction interaction of blend components," *Procedia Chem.* 2014; 10:477-84; and Giglio V et al., "Experimental evaluation of reduced kinetic models for the simulation of knock in SI engines," *SAE Int'l Technical Paper No.* 2011-24-0033, 2011, 11 pp.). Despite these efforts, a detailed understanding of why certain fuel additives blend synergistically (i.e. generate higher octane number than that which would be predicted based on the relative mole fraction of the additive and a linear blending rule), while others blend antagonistically is still not well understood. This is because these phenomena intrinsically depend on chemical interactions among the numerous components of the fuel blend in the combustion cycle (see, e.g., Boot M D et al., *Prog. Energ. Combust. Sci.* 2017; 60:1-25; American Petroleum Institute, "Determination of the potential property ranges of mid-level ethanol blends," Washington, D C, 2010, 107 pp.; Park S et al., "Combustion characteristics of $C_5$ alcohols and a skeletal mechanism for homogeneous charge compression ignition combustion simulation," *Energy Fuels* 2015; 29:7584-94; Wallner T et al., "Analytical assessment of C2-C8 alcohols as spark-ignition engine fuels," *Proceedings of the FISITA* 2012 *World Automotive Congress* (Society of Automotive Engineers of China (SAE-China) and International Federation of Automotive Engineering Societies (FISITA), eds.), Springer-Verlag Berlin Heidelberg, Germany, 2013, pp. 15-26; Anderson J E et al., "Octane numbers of ethanol-gasoline blends: measurements and novel estimation method from molar composition," *SAE Technical Paper No.* 2012-01-1274, 2012, 17 pp.; and Stein R A et al., "Effect of heat of vaporization, chemical octane, and sensitivity on knock limit for ethanol—gasoline blends," *SAE Int'l J. Fuels Lubr.* 2012; 5:823-43).

In previous efforts to identify new fuel additives for increasing engine efficiency, hundreds of biofuel molecules have been evaluated for neat RON and MON to establish suitability as an octane boosting or antiknock agent (see, e.g., Morganti K J et al., *Fuel* 2013; 108:797-811; Mack J H et al., "Investigation of biofuels from microorganism metabolism for use as anti-knock additives," *Fuel* 2014; 117:939-43; Christensen E et al., "Renewable oxygenate blending effects on gasoline properties," *Energy Fuels* 2011; 25:4723-33; and McCormick R L et al., "Selection criteria and screening of potential biomass-derived streams as fuel blendstocks for advanced spark-ignition engines," *SAE Int'l J. Fuels Lubr.* 2017; 10:442-60). The RON of the neat compound is commonly used to interpolate the maximum RON of the resulting fuel blend since it assumed that the RON of a mixture will never exceed the bounds of the RON values for its constituents (the compound and the blendstock). This has held true in all known studies published to date, with recent efforts using the neat RON as a means to screen potential renewable fuel candidates (see, e.g., McCormick R L et al., *SAE Int'l J. Fuels Lubr.* 2017; 10:442-60). Here, we provide data that question the implicit bounds of the RON interpolation assumption, documented for the case of a potential biobased fuel candidate, 3-methyl-2-buten-1-ol, also known as prenol.

Example 3: Experimental Methodology and Materials

Provided herein are experimental details for data provided within the Examples.

General Approach and Octane Number Testing:

Prenol was blended volumetrically into various gasoline samples, referred to as Reformulated Blendstocks for Oxygenated Blending (RBOBs), and the Research Octane Number (RON) and Motor Octane Number (MON) of the mixtures were measured. Volumetric blending was measured using graduated cylinders. RON and MON were determined via ASTM D2699 and ASTM D2700, respectively. More than one RON and MON testing laboratory was utilized to ensure data quality and reproducibility. Octane testing and volumetric blending of prenol from 0-30% (v/v) into RBOB 1, RBOB 2, RBOB 3, and RBOB 4 was performed at Intertek Inc. (Benecia, Calif.).

Octane testing of prenol from 0-30% (v/v) into a 4-component surrogate fuel and 0-100% (v/v) into RBOB 5, as well as the blending into the surrogate and RBOB 5 with ethanol (E10 mixes), was performed at Southwest Research Institute (SwRI, San Antonio, Tex.). Formulation of the blends in RBOB 5 was done volumetrically at SwRI, while blending into the 4-component surrogate was done by mass % using the known densities of the constituents at the National Renewable Energy Laboratory (Golden, Colo.). The detailed hydrocarbon composition of RBOB 4, RBOB 5, and the surrogate fuel was measured (Tables 1-3). The stoichiometric air/fuel ratio was calculated for each mixture tested and when this ratio was <12.5, the fuel jets on the CFR were modified as outlined by Hunwartzen et al. (see, e.g., Hunwartzen I, "Modification of CFR test engine unit to determine octane numbers of pure alcohols and gasoline-alcohol blends," *SAE Technical Paper Series No.* 820002, 1982, 6 pp.).

TABLE 1

Detailed composition of RBOB 4

| | Paraffins | I-Paraffins | Olefins | Napthenes | Aromatics | Unknowns | Total |
|---|---|---|---|---|---|---|---|
| C1 | 0.00000 | 0.00000 | 0.00000 | 0.00000 | 0.00000 | 0.00000 | 0.00000 |
| C2 | 0.01153 | 0.00000 | 0.00000 | 0.00000 | 0.00000 | 0.00000 | 0.01153 |
| C3 | 0.20194 | 0.00000 | 0.00000 | 0.00000 | 0.00000 | 0.00000 | 0.20194 |
| C4 | 7.35223 | 1.42087 | 0.14493 | 0.00000 | 0.00000 | 0.00000 | 8.91800 |
| C5 | 1.87764 | 8.28285 | 2.72245 | 0.26019 | 0.00000 | 0.00000 | 13.14313 |
| C6 | 1.59425 | 8.08656 | 3.67912 | 2.76910 | 1.10848 | 0.06490 | 17.30242 |
| C7 | 0.98681 | 4.53372 | 2.38401 | 3.70633 | 5.21488 | 0.02824 | 17.75400 |
| C8 | 0.27954 | 3.88074 | 0.39785 | 2.98529 | 7.72408 | 0.70576 | 15.97325 |
| C9 | 0.08788 | 2.28490 | 0.25325 | 2.15441 | 6.84974 | 0.21635 | 11.84654 |
| C10 | 0.17678 | 1.20235 | 0.03760 | 0.41433 | 6.42552 | 0.68426 | 8.94084 |
| C11 | 0.13290 | 0.62578 | 0.01923 | 0.08358 | 0.78102 | 0.40920 | 2.05171 |
| C12 | 0.01148 | 0.44324 | 0.01704 | 0.05900 | 0.99076 | 0.82566 | 2.34718 |
| C13 | 0.00000 | 0.12086 | 0.01172 | 0.00000 | 0.00000 | 1.24933 | 1.38191 |
| Total: | 12.71297 | 31.78186 | 9.66720 | 12.43223 | 29.09448 | 4.18370 | 95.68875 |
| | Oxygenates | 0.00200 | | Total C14+: | 0.12755 | | |
| | Total Unknowns: | 4.18370 | | Grand Total: | 100.00000 | | |

TABLE 2

Composition of RBOB 5 (by class)

| Group | % Wgt | % Vol | % Mol |
|---|---|---|---|
| Paraffin | 12.325 | 13.809 | 13.045 |
| I-Paraffins | 36.679 | 9.787 | 35.726 |
| Aromatics | 29.623 | 25.101 | 27.602 |
| Mono-Aromatics | 28.713 | 24.404 | 26.934 |
| Naphthalenes | 0.350 | 0.256 | 0.247 |
| Naphtheno/Olefino-Benz | 0.555 | 0.437 | 0.417 |
| Indenes | 0.005 | 0.004 | 0.004 |
| Naphthenes | 13.129 | 12/21 | 13.991 |
| Mono-Naphthenes | 13.129 | 12.721 | 13.991 |
| Di/Bicyclo-Naphthenes | 0.000 | 0.000 | 0.000 |
| Olefins | 6.533 | 6.915 | 7.285 |
| n-Olefins | 1.954 | 2.130 | 2.291 |
| Iso-Olefins | 3.845 | 4.067 | 4.226 |
| Naphtheno-Olefins | 0.731 | 0.714 | 0.764 |
| Di-Olefins | 0.003 | 0.003 | 0.003 |
| Oxygenates | 0.457 | 0.455 | 0.460 |
| Unidentified | 1.255 | 1.211 | 0.991 |

TABLE 3

Composition of RBOB 5 (by carbon)

| C# | % Wgt | % Vol | % Mol |
|---|---|---|---|
| C3 | 0.079 | 0.108 | 0.167 |
| C4 | 1.077 | 1.373 | 1.821 |
| C6 | 9.962 | 11.619 | 13.702 |
| C6 | 17.428 | 18.202 | 20.156 |
| C7 | 25.055 | 24.663 | 25.501 |
| C8 | 26.034 | 25.162 | 23.157 |
| C9 | 11.907 | 10.991 | 9.505 |
| C10 | 5.398 | 5.056 | 3.846 |
| C11 | 1.375 | 1.253 | 0.892 |
| C12 | 0.403 | 0.336 | 0.248 |
| C13 | 0.016 | 0.015 | 0.008 |
| C14 | 0.011 | 0.011 | 0.006 |
| C15 | 0.001 | 0.001 | 0.000 |

Confirmation of Sample Volume Fractions:

Concentrations of prenol in blends were measured by gas chromatography (GC). Prenol was separated from the hydrocarbon matrix by two-dimensional heart-cutting GC with an Agilent 7890A GC equipped with a microfluidic switching valve and dual flame ionization detectors. The columns used were an Equity-1, 100% polydimethyl siloxane (30 m×0.25 mm, 0.25 m df) as the non-polar phase and a Supelco, IL-59 ionic liquid (30 m×0.25 mm, 0.2 m df) as the polar phase. A deactivated fused silica restrictor (0.77 m×0.1 mm) was used to connect from the non-polar column from the microfluidic switch to the flame ionization detector. The GC oven was set to 50° C. and held for 15 minutes followed by a temperature ramp of 10° C./min to a final temperature of 250° C. The injection port temperature was set to 250° C., and both detectors were set to 275° C. The injection volume was 1 μL with a split ratio of 200:1. Instrument response was calibrated with a gravimetrically prepared mixture of prenol at five calibration points, in the region corresponding to the expected concentration of the blends. Calibration curves were found to have $R^2$ values of 0.998 or greater for all compounds (see, e.g., McCormick R L et al., *SAE Int'l J. Fuels Lubr.* 2017; 10:442-60).

Chemicals and Purities Used for RON Testing:

Sigma-Aldrich was used as the vendor for all the chemicals investigated. High purity samples (>98%) were purchased to ensure data reproducibility. The exact product number and associated purity can be seen in Tables 4-5. Samples were used for testing immediately after the containers were opened to avoid sample degradation.

TABLE 4

List of contaminants and their corresponding m/z from the unprocessed sample used for blend testing as determined via GC-MS

| Compound | Dominant m/z |
|---|---|
| 1,4 pentadiene | 67.1 |
| 1-butene, 3-methyl-3-[(3-methyl-2-butenyl) oxy] | 139.1 |
| 1-pentanol | 70.1 |
| 3-methyl-2-buten-1-ol | 68.1 |
| 2-pentene,4,4'-oxybis | 64.1 |

TABLE 5

List of chemical vendor, purity, and product numbers for chemicals

| Chemical | Vendor | Product Number | Purity |
|---|---|---|---|
| 3-methyl-2-buten-1-ol | Sigma-Aldrich | W364703 | >98% |
| 3-methyl-3-buten-1-ol | Sigma-Aldrich | W519308 | >97% |
| 2-methyl-3-buten-2-ol | Sigma-Aldrich | W503908 | >98% |
| 3-methyl-1-butanol | Sigma-Aldrich | M32658 | 98% |
| 2-methyl-1-butanol | Sigma-Aldrich | 65990 | >98% |

Removal of Polar Contaminants from Prenol Samples:

Potential polar contaminants, such as peroxides and hydrates, were removed from the neat prenol sample using a silica column following the protocol outlined by Mueller et al. (see, e.g., Mueller C J et al., "Diesel surrogate fuels for engine testing and chemical-kinetic modeling: compositions and properties," *Energy Fuels* 2016; 30:1445-61). RON testing of this sample was conducted to confirm that these contaminants were not affecting the RON measurement. The sample containers were stored at 85% capacity and sealed with parafilm to limit peroxide formation after the silica column treatment; testing was performed within 10 days of the treatment.

Determination of Prenol Sample Purity:

The peroxide number of the silica column treated sample (sample processed as described above) was tested by the ASTM D3703 method at SwRI. This method quantified the concentration hydroperoxides in a sample within the range of 0-50 mg/kg (ppm). To further validate the >98% purity of the prenol used for RON and MON testing, samples were analyzed for contaminants via GC-MS with only trace contaminants found (see Tables 4-5).

Uncertainties:

For fuels in the 90 to 100 RON range, the method reproducibility is 0.7 ON (repeated tests would differ by more than 0.7 ON, no more than 5% of the time) (see, e.g., ASTM International, "Standard test method for Research Octane Number of spark-ignition engine fuel," Designation No. ASTMD2699-16, West Conshohocken, Pa., 2016). The absolute value of the average error from the target volume range for the samples that were determined was 1.39 volume % so the samples that were not quantified by GC can be expected to have a similar blending volume error. Multiple gasoline samples were used to address variability in materials.

Example 4: Octane Hyperboosting Phenomena

RON values of neat prenol and blends into different gasoline BOBs as well as fuel surrogates were measured as described in the Examples above. The neat RON value of prenol is reported as 93.6 and is the average of four independent measurements with a standard deviation of 0.61 which is within the accepted error of the test (0.7). The RBOB samples used as the base fuel cover a wide range of starting RON values, and each has a unique hydrocarbon composition. Prenol was also blended into a simplified surrogate gasoline including iso-octane (55 vol %), n-heptane (15 vol %), toluene (25 vol %), and 1-hexene (5 vol %) that has been used as a base fuel for comparing blending octane numbers for a wide range of potential high-octane gasoline blendstocks (see, e.g., McCormick R L et al., *SAE Int'l J. Fuels Lubr.* 2017; 10:442-60; Cai L et al., "Optimized chemical mechanism for combustion of gasoline surrogate fuels," *Combust. Flame* 2015; 162:1623-37; and Mehl M et al., "An approach for formulating surrogates for gasoline with application toward a reduced surrogate mechanism for CFD engine modeling," *Energy Fuels* 2011; 25:5215-23). The composition of the RBOB samples, where available, are provided in Tables 1-3.

FIG. 1 shows the results from the RON tests of neat prenol and each of the blends investigated, as described herein. It was observed that the RON of the prenol-containing fuel blend exceeds the RON of both the neat compound and the base fuel for all RBOBs into which prenol was blended. The term "octane hyperboosting" has been applied to describe this effect to distinguish it from synergistic blending or RON boosting commonly used to describe non-linear RON blending. RON testing of prenol in the surrogate fuel with 10% by volume ethanol was also carried out and is discussed herein. The octane hyperboosting effect was observed at or below the 20% (v/v) prenol blend level in all base fuels, with RBOB 2 and the surrogate showing the hyperboosting effect by 10% (v/v) prenol. The range of the observed octane hyperboosting effect at 30% (v/v) varied from 1.3 to 4.8 ON, which is well outside of the experimental variability (±0.7 ON) of the test over this range.

To our knowledge, the octane hyperboosting as described herein has not been documented to-date. In studies evaluating binary systems, (rather than complex mixtures described herein), Foong et al. reported the RON of an iso-octane and ethanol blend to be as high as 110.2, which is above the RON of both iso-octane (100) and ethanol (108.5) (see, e.g., Anderson J E et al., *SAE Technical Paper No.* 2012-01-1274, 2012, 17 pp.; and Foong T M et al. "The octane numbers of ethanol blended with gasoline and its surrogates," Fuel 2014; 115:727-39), while Scott reports a similar phenomenon for diisobutylene in an iso-octane base fuel (see, e.g., Scott E J Y, "Knock characteristics of hydrocarbon mixtures," *SAE J.* 1958; 38:90). However, the error of the RON tests in this value range is at least 3.2 octane numbers as defined in the ASTM standard for the RON measurement (see, e.g., ASTM International, "Standard test method for Research Octane Number of spark-ignition engine fuel," Designation No. ASTMD2699-16, West Conshohocken, Pa., 2016), and neither has been repeated.

As stated, the purity of the prenol sample evaluated was always >98%. It has been previously shown that impurities such as peroxides can have large impacts on the cetane values for diesel fuels because these impurities can be a trigger to an already auto-ignition sensitive fuel. Since high octane fuels quench radical pool-building reactions, the impurities previously listed would likely require stoichiometric loadings to cause a significant effect. To fully validate impact of polar impurities such as peroxides on the neat RON measurement of prenol, a sample was processed to remove polar contaminants as demonstrated by Wallace et al. (see, e.g., Wallace L A et al., "Use of column chromatography to improve ignition delay characteristics of impure methylcyclohexane in the ASTM D 7170 FIT combustion analyzer," ASTM, Galena Park, TX, 2008) and Mueller et al. (see, e.g., Mueller C J et al., *Energy Fuels* 2016; 30:1445-61), as described herein. The outcome from the ASTM D3703 test for hydroperoxides on this processed sample showed "non-detect", with a testing range of 0-50 mg/kg. The neat RON of the treated prenol sample was measured as 94.6, indicating that polar impurities may have been depressing the neat RON measurement slightly, but not to a level that would question the nature of the octane hyperboosting phenomenon, given the uncertainty ranges in the tests. The list of the five most abundant impurities in the prenol sample used as determined by GC-MS are shown in Table 4.

Further blending and octane testing was carried out beyond the 10, 20, and 30% blend levels to determine the blending volume where the octane hyperboosting effect was no longer observed and the RON was reduced to that of neat prenol. Blending was done at 10% (v/v) increments up to 90% to eliminate the possibility that additional nonlinearities were present at other blending ratios, and a closely related isomer (3-methyl-3-buten-1-ol, or isoprenol) was also tested to determine if it also showed the hyperboosting behavior. The RBOB used for the full blend range had a very low octane, so it represents a lower bound for the hyperboosting effect, as more hyperboosting would need to occur to exceed the neat RON of prenol.

Figure 2:
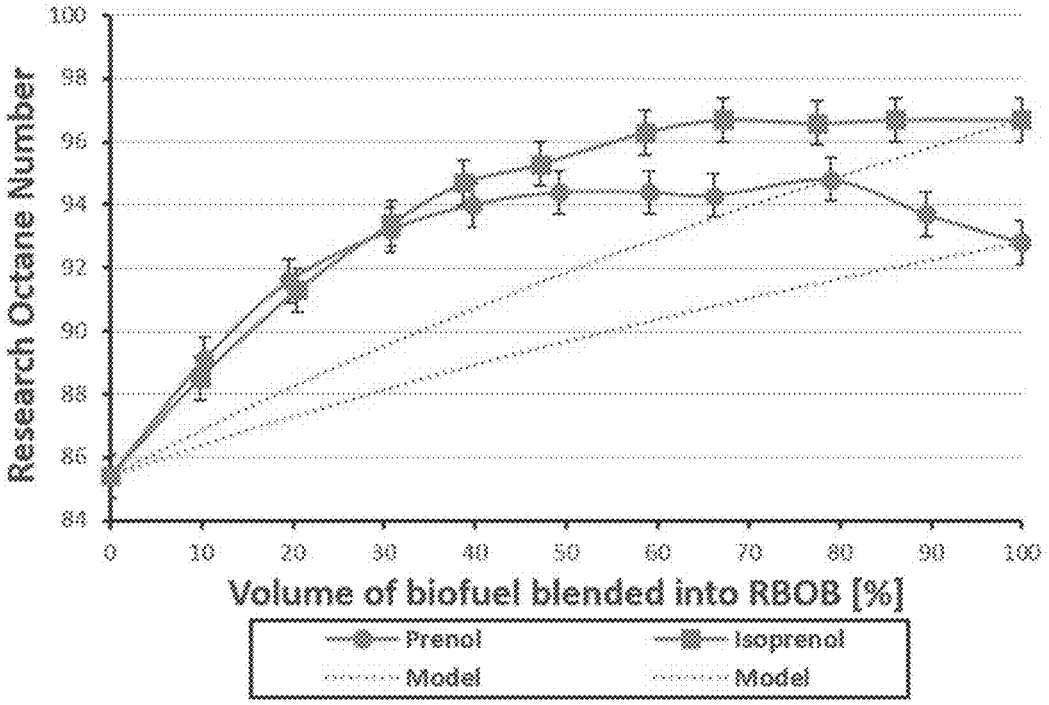
FIG. 2 is a graph showing the full blending profile of prenol and isoprenol in the RBOB 5 gasoline sample. Isoprenol reaches its neat RON value between 50% and 60% by volume but never exceeds it. Dashed lines represent the theoretical "linear" blending curve when blended as a function of blending molar fraction.
Figure 3A:
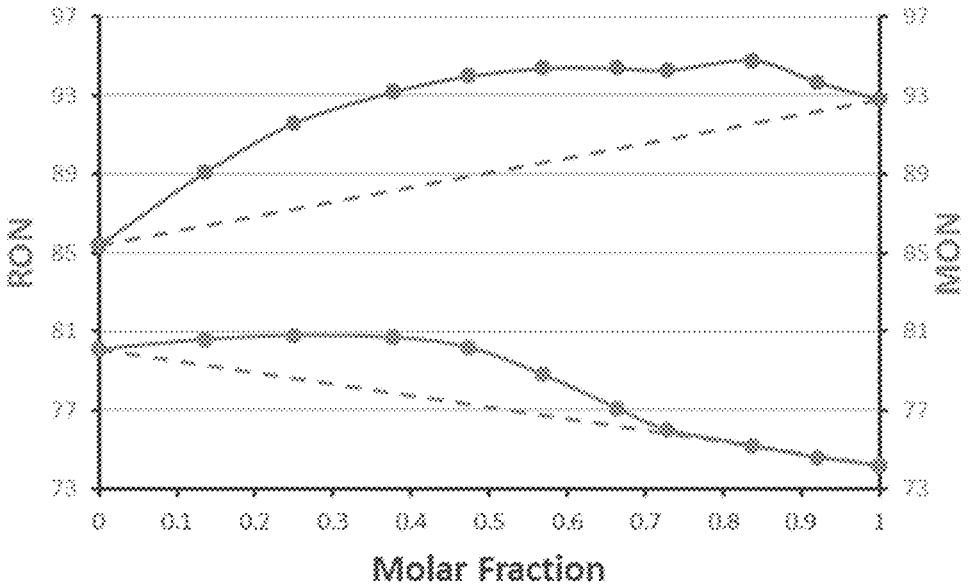
FIG. 3A-3B provides graphs showing the full 0-100% by volume blending of (A) prenol and (B) isoprenol into RBOB 5. Provided are RON values (left axis, top curve) and MON values (right axis, lower curve). The RON hyperboosting effect is seen from 30% blending volume to 90% blending volume in prenol. In isoprenol, the RON hyperboosting effect is not seen at any volume %, as the RON levels out at the neat RON value above 60% by volume.
Figure 3B:
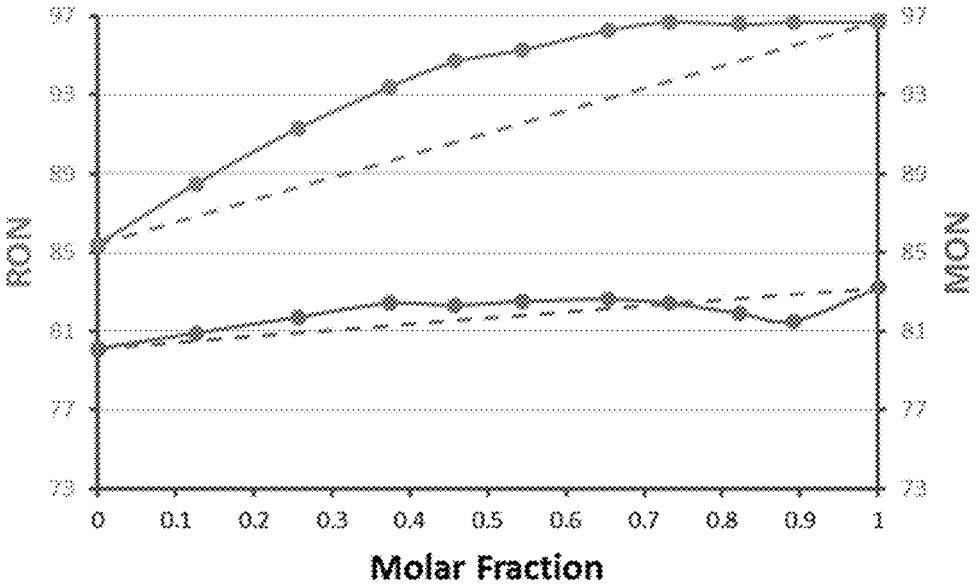

The full blending range for prenol and isoprenol is shown in FIG. 2. When blended from 0-100% in RBOB 5, the octane hyperboosting effect was seen at every data point between 30% and 90% (v/v) for prenol. No octane hyperboosting was observed for isoprenol, even at the higher blending volumes, suggesting that the underlying chemical basis for octane hyperboosting is present in prenol but not isoprenol.

As expected, the octane hyperboosting effect for RBOB 5 is the least extreme case of octane hyperboosting among all the gasoline blendstocks investigated. The largest difference between a blended RON value and the neat RON of prenol is just 2 RON points and was observed at the 80% blend, while the hyperboosting effect was not noticed until beyond 20% (v/v). Future work focusing on the specific hydrocarbon makeup of the base fuel and how this relates to the performance of prenol blends could lead to a more detailed understanding of the chemical underpinnings of octane hyperboosting.

Figure 4:
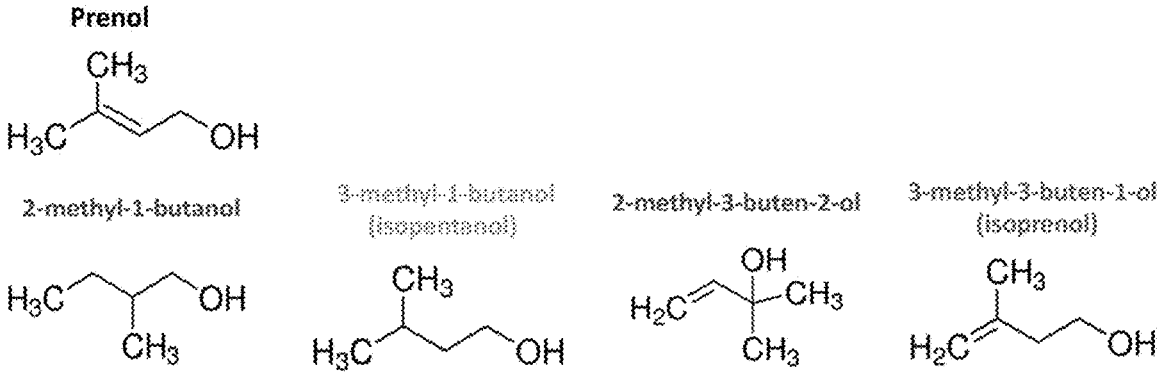
FIG. 4 provides chemical structures of prenol and other compounds described herein. Each compound explored contains five carbons and an alcohol functional group.

To further investigate if octane hyperboosting is unique to prenol, three additional compounds with structural similarities to prenol (2-methyl-1-butanol, 3-methyl-1-butanol (isopentanol), and 2-methyl-3-buten-2-ol) were evaluated, despite previous investigations not revealing octane hyperboosting for these compounds (see, e.g., Park S et al., *Energy Fuels* 2015; 29:7584-94; Mack J H et al., Fuel 2014; 117:939-43; and McCormick R L et al., *SAE Int'l J. Fuels Lubr.* 2017; 10:442-60). The structures for these molecules, including isoprenol, are shown in FIG. 4.

Figure 5:
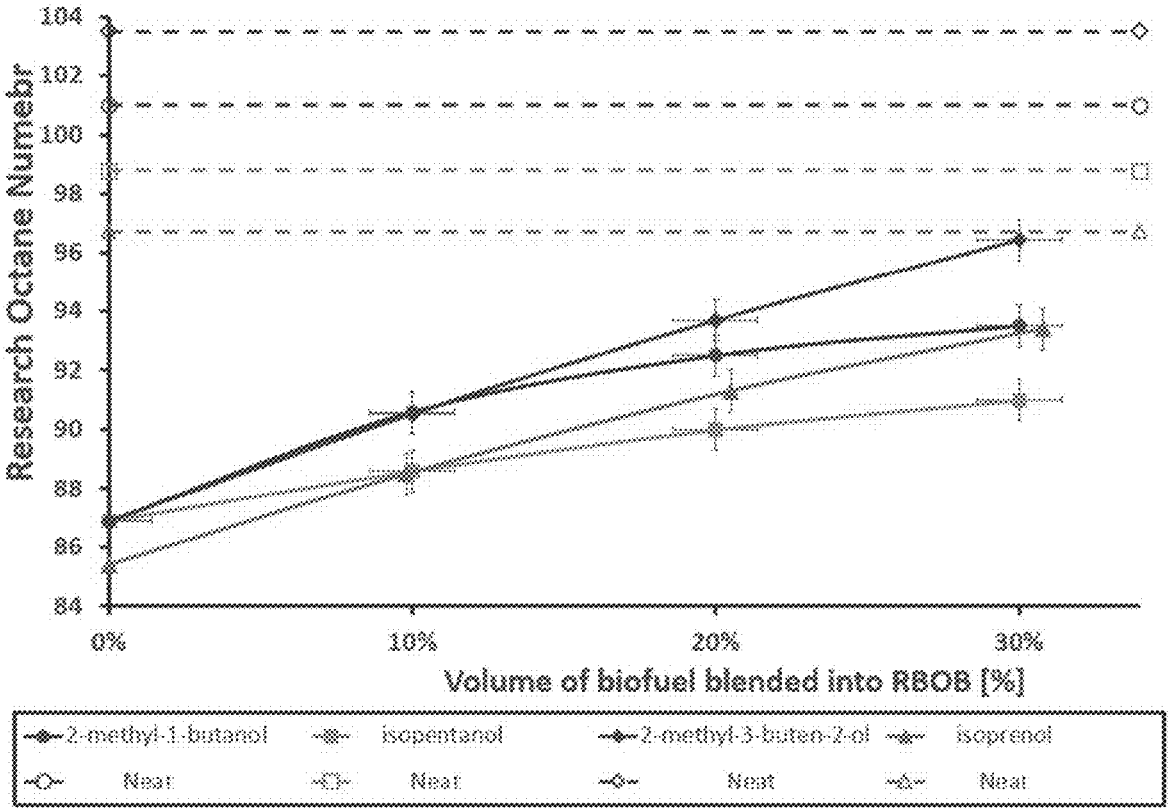
FIG. 5 provides investigation of additional C5 alcohol candidates for octane hyperboosting. 2-methyl-1-butanol, isopentanol, and 2-methyl-3-buten-2-ol were blended into RBOB 4 (starting RON 86.9), while isoprenol was blended into RBOB 5 (starting RON 85.4). The solid lines represent the experimental RON data of the blends, while the dotted lines represent the neat RON measurement for each of the compounds investigated.

Blending of 2-methyl-1-butanol, isopentanol, and 2-methyl-3-buten-2-ol was done into the RBOB 4 sample, while isoprenol was blended into the RBOB 5 sample as previously described. The RON testing of these compounds is shown in FIG. 5 and shows that none of these compounds demonstrate octane hyperboosting.

The fact that prenol is the only compound to demonstrate this behavior despite being only subtly structurally different from the other compounds investigated should be explored further and other compounds that share structural similarities or similar reaction intermediates should be investigated. Work is currently underway to understand this unique behavior via targeted experiments and by exploring new kinetic modeling strategies. If fully understood, octane hyperboosting could have significant impacts on how fuels are blended, the way the RON and MON tests are used, and could be leveraged for design of new biofuel/bioblendstocks for maximum antiknock performance.

Example 5: Evaluation of Prenol as a Fuel Additive

Table 6 provides some relevant fuel properties for prenol and the other octane boosting biofuels that have been heavily investigated for use as additives to gasoline. It also highlights the high octane sensitivity of prenol, which is defined as the difference between the RON and MON measurements. Each of the properties listed is anticipated to have some contribution to the octane performance of the molecule or is important from an infrastructure compatibility perspective.

TABLE 6

Relevant fuel properties for various compounds

| Compound | Neat RON | Neat MON | Octane Sensitivity (RON-MON) | DH Vap [kJ/kg] | Water Solubility [g/L][a] | Boiling Point [° C.] | Energy Density [MJ/L] |
|---|---|---|---|---|---|---|---|
| Ethanol | 109 | 90 | 19 | 919 | 1000 | 78.5 | 20.2 |
| n-propanol | 104 | 89 | 15 | 789 | 1000 | 97.2 | 24.7 |
| Isopropanol | 112.5 | 96.7 | 15.8 | 744 | 1000 | 82.5 | 24.1 |
| Isobutanol | 105 | 90 | 15 | 685 | 85 | 107.9 | 26.6 |
| Cyclopentanone | 101 | 89 | 12 | 504 | 61 | 130.6 | 30.2 |
| Prenol | 93.5 | 74.2 | 19.3 | 512 | 41 | 140.0 | N/A |

All values shown are experimental values sourced from the US-DOE Co-optima fuel property database, "Co-optimization of fuels & engines (Co-Optima) project," accessible at https://fuelsdb.nrel.gov/fmi/webd/FuelEngineCoOptimization. [a]Measured at 25° C.

Figure 6:
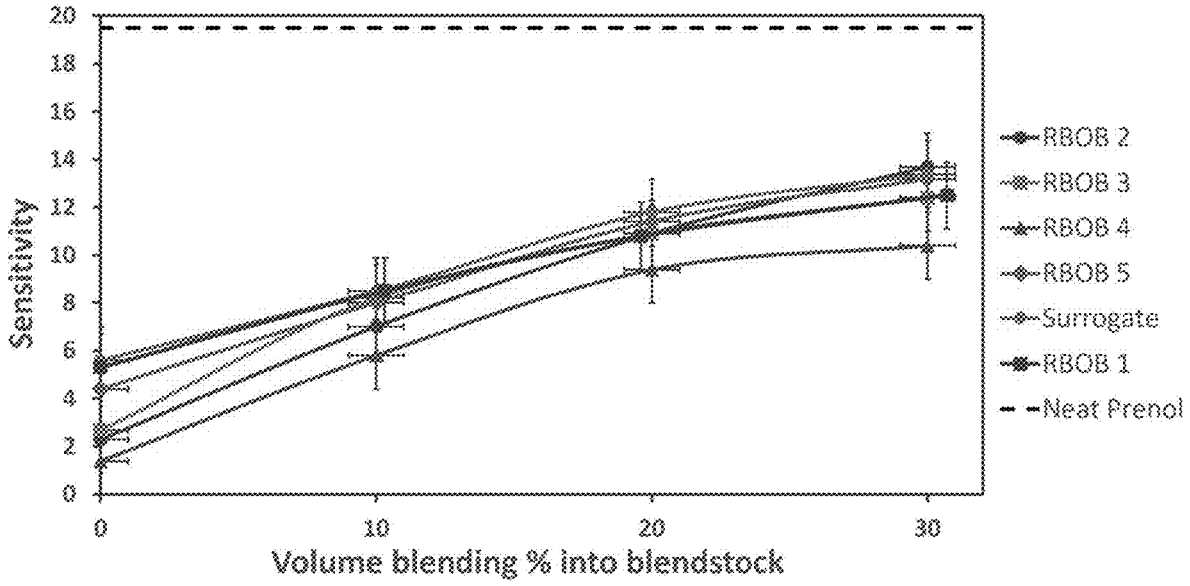
FIG. 6 is a graph of sensitivity values for various fuel blends.

Recent studies have suggested that high octane sensitivity may be critical to limiting engine knock and improving efficiency in modern downsized turbocharged engines as well as in advanced combustion strategies currently in development (see, e.g., Mittal V et al., *SAE Int'l J. Engines* 2010; 2(2):1-10; and Vuilleumier D et al., "The use of transient operation to evaluate fuel effects on knock limits well beyond RON Conditions in spark-ignition engines," *SAE Technical Paper No.* 2017-01-2234, 2017, 14 pp). Sensitivity values for all the blends of prenol into RBOBs are provided in FIG. 6 and Table 7 (tabulated values for data in FIG. 6).

TABLE 7

Tabulated values showing sensitivity (RON-MON) for each blend investigated

| | Volume % into Blendstock | | | |
|---|---|---|---|---|
| | 0 | 10 | 20 | 30 |
| RBOB 1 | 2.3 | 7 | 10.9 | 13.7 |
| RBOB 2 | 2.7 | 8.2 | 10.9 | 12.4 |
| RBOB 3 | 1.4 | 5.8 | 9.4 | 10.4 |
| RBOB 4 | 4.4 | 8 | 11.4 | 13.2 |
| RBOB 5 | 5.3 | 8.5 | 10.8 | 12.5 |
| Surrogate | 5.6 | 8.5 | 11.8 | 13.4 |

Additionally, many of prenol's physical properties such as molecular weight, boiling point, density and others are very similar to those of traditional gasoline components while features such as low water solubility and higher energy density could lead to enhanced infrastructure compatibility compared to existing biofuels, such as ethanol.

Example 6: Prenol in Combination with Ethanol

To assess the impact of ethanol on prenol's blending behavior, prenol was blended into two gasoline base fuels containing 10% by volume ethanol (referred to as "E10"). These results are shown in Table 8 and demonstrate that prenol/ethanol blends have elevated RON and sensitivity values that are beyond what each component can provide individually. This is clearly shown for the 20% volume addition of prenol into the surrogate E10 (30% by volume total biofuel), where the sensitivity value of 13.7 is significantly higher than the sensitivity value of 30% ethanol in the surrogate, which is reported by McCormick et al. to be 11.4 (see, e.g., Mack J H et al., *Fuel* 2014; 117:939-43; and/or McCormick R L et al., *SAE Int'l J. Fuels Lubr.* 2017; 10:442-60). The potential for optimized blends of ethanol/prenol blends may allow for improved engine efficiency as well as the opportunity to bypass the ethanol "blend wall" which would allow for increased biofuel use and reduced carbon emissions.

TABLE 8

Antiknock metrics of prenol blended in base fuels with 10% by volume ethanol added (E10 fuels), in which blends were tested for the 4-component surrogate and RBOB 5

| | | Volume % Prenol Added | | | |
|---|---|---|---|---|---|
| Measurement | Base Fuel | 0 | 10 | 20 | 30 |
| RON | Surr. E10 | 95.6 | 98.1 | 99.3 | 99.1 |
| | RBOB 5 E10 | N/A | 94.2 | 95.3 | 96.3 |
| MON | Surr. E10 | 88.3 | 87.2 | 85.6 | 84.5 |
| | RBOB 5 E10 | N/A | 82.4 | 81.9 | 81.5 |
| Sensitivity | Surr. E10 | 7.3 | 10.9 | 13.7 | 14.6 |
| | RBOB 5 E10 | N/A | 11.8 | 13.4 | 14.8 |

Example 7: Production Routes to Prenol

Due to the promising octane boosting behavior of prenol and its potential as a biofuel, a review of strategies for large scale production of prenol was carried out. Prenol is produced industrially via a catalytic route developed by BASF as an intermediate in the production of citral (see, e.g., Hoelderich W F et al., "Heterogeneously catalysed oxidations for the environmentally friendly synthesis of fine and intermediate chemicals: synergy between catalyst development and reaction engineering," in Catalysis (Volume 16, J J Spivey (senior reporter)), The Royal Society of Chemistry, Cambridge, UK, 2002, Chapter 2, pp. 43-66), with other patents and publications focusing on catalyst development and reaction conditions (see, e.g., Rebafka W, "Manufacture of but-2-en-1-ol compounds by isomerizing the corresponding but-3-en-1-ol compounds," U.S. Pat. No. 4,310,709, filed Apr. 23, 1980, issued Jan. 12, 1982; and Kogan S B et al., "Liquid phase isomerization of isoprenol into prenol in hydrogen environment," *Appl. Catal. A* 2006; 297:231-6).

Furthermore, significant work has been done around biological production of prenol by dephosphorylation of metabolic intermediates of the isoprenoid biosynthetic pathways, isopentenyl diphosphate (IPP) and dimethylallyl diphosphate (DMAPP), via the expression of a promiscuous phosphatase enzyme (see, e.g., George K W et al., "Metabolic engineering for the high-yield production of isoprenoid-based $C_5$ alcohols in *E. coli*," *Sci. Rep.* 2015; 5: Art. No. 11128 (12 pp.); and Chou H H et al., "Synthetic pathway for production of five-carbon alcohols from isopentenyl diphosphate," *Appl. Environ. Microbiol.* 2012; 78:7849-55). While the most successful engineering strategies reported to date have primarily demonstrated the production of isoprenol (~2.5 g/L), there are reports that suggest that it is possible to selectively produce prenol using enzymes that preferentially dephosphorylate DMAPP (see, e.g., Zheng Y et al., "Metabolic engineering of *Escherichia coli* for high-specificity production of isoprenol and prenol as next generation of biofuels," *Biotechnol. Biofuels* 2013; 6:57 (13 pp.)), suggesting potential for prenol as an industrially relevant biofuel that can also serve as an anti-knock blend.

A promising means to significantly increase the efficiency of the gasoline engine fleet is to increase the compression ratio, which would be enabled by the use of higher octane fuels. As described herein, we provide details of octane hyperboosting by an oxygenated fuel compound, prenol, as characterized by the RON of a mixture exceeding the RON of both the neat blending agent and the blendstock. This finding counters the widely held assumption that interpolation between the RON values of a pure compound and the base fuel provides the bounds of the RON performance of the blend. This is clearly distinct from the synergistic blending of oxygenates with gasoline that has been observed to-date. Octane hyperboosting was observed for blends of prenol into a variety of gasoline mixtures and tested by multiple commercial laboratories. Testing of structurally similar molecules showed prenol to be unique in its octane hyperboosting effect. This phenomenon suggests an unexplored area for combustion research by potentially providing a new approach for improving SI combustion efficiency and enabling identification of previously overlooked fuels based on presumed limitations of their anti-knock performance. Prenol itself has promising properties as a biofuel such as extremely high octane sensitivity, low water solubility, and energy density close to that of gasoline; the hyperboosting effect means that in a correctly formulated blendstock prenol could outperform biofuels in the market today.

OTHER EMBODIMENTS

All publications, patents, and patent applications mentioned in this specification are incorporated herein by reference to the same extent as if each independent publication or patent application was specifically and individually indicated to be incorporated by reference.

While the invention has been described in connection with specific embodiments thereof, it will be understood that it is capable of further modifications and this application is intended to cover any variations, uses, or adaptations of the invention following, in general, the principles of the invention and including such departures from the present disclosure that come within known or customary practice within the art to which the invention pertains and may be applied to the essential features hereinbefore set forth, and follows in the scope of the claims.

Other embodiments are within the claims.

The invention claimed is:

1. A fuel mixture comprising:

a fuel;

an optional ethanol additive in an amount of from about 5% (v/v) to about 50% (v/v); and an alkenol additive in an amount of from about 15% (v/v) to about 95% (v/v).

2. The fuel mixture of claim 1, wherein the fuel is selected from the group consisting of a gasoline, a biofuel, a blendstock, a hydrocarbon, and a combination thereof.

3. The fuel mixture of claim 2, wherein the fuel is selected from the group consisting of conventional gasoline, oxygenated gasoline, reformulated gasoline, biofuel, biogasoline, biodiesel, Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), gasoline treated as blendstock (GTAB), crude oil, fuel oil, distillate fuel oil, diesel fuel, jet fuel, petroleum, a surrogate fuel, and a combination thereof.

4. The fuel mixture of claim 3, wherein the fuel comprises a RBOB.

5. The fuel mixture of claim 1, wherein the fuel comprises an alkylate, a paraffin, an olefin, a reformate, a naphthene, a ketone, or an aromatic.

6. The fuel mixture of claim 1, wherein the alkenol additive is an optionally substituted $C_{1-10}$ alkenol.

7. The fuel mixture of claim 6, wherein the alkenol additive comprises an optionally substituted branched $C_{1-10}$ alkenol.

8. The fuel mixture of claim 6, wherein the alkenol additive comprises prenol and/or isoprenol.

9. The fuel mixture of claim 1, wherein the alkenol additive is present in an amount of from about 30% (v/v) to about 85% (v/v).

10. The fuel mixture of claim 1, comprising butane, pentane, heptane, octane, hexene, toluene, or a combination thereof.

11. The fuel mixture of claim 1, wherein a Research Octane Number (RON) of the fuel mixture is greater than a RON of the alkenol additive.

12. A fuel mixture comprising:

a fuel;

an optional ethanol additive in an amount of from about 5% (v/v) to about 50% (v/v); and an isopentenol, or an isomer thereof, in an amount of from about 15% (v/v) to about 95% (v/v).

13. The fuel mixture of claim 12, wherein the fuel comprises a RBOB.

14. The fuel mixture of claim 12, wherein the isopentenol is present in an amount of from about 30% (v/v) to about 85% (v/v).

15. The fuel mixture of claim 12, wherein the isopentenol is prenol and/or isoprenol.

16. A method of preparing a fuel mixture, the method comprising:

blending an alkenol additive into a fuel, thereby providing a fuel mixture comprising the alkenol additive in an amount of from about 15% (v/v) to about 95% (v/v).

17. The method of claim 16, wherein the alkenol additive is an optionally substituted $C_{1-10}$ alkenol.

18. The method of claim 16, further comprising, before the blending step:

purifying the alkenol additive by removing one or more polar contaminants, thereby providing a purified alkenol additive.

19. The method of claim 18, wherein the purified alkenol additive does not include a peroxide or a hydrate.

20. The method of claim 16, further comprising, after the blending step: determining a Research Octane Number (RON) of the fuel mixture that is greater than a RON of the alkenol additive.

* * * * *